US012714272B2

(12) United States Patent
Qiu et al.

(10) Patent No.: US 12,714,272 B2
(45) **Date of Patent: *Aug. 25, 2026**

(54) FLOOR BRUSH ASSEMBLY FOR VACUUM CLEANER, AND VACUUM CLEANER

(71) Applicants: JIANGSU MIDEA CLEANING APPLIANCES CO., LTD., Suzhou (CN); MIDEA GROUP CO., LTD., Foshan (CN)

(72) Inventors: Zhihong Qiu, Suzhou (CN); Yakun Wang, Suzhou (CN); Jianming Huang, Suzhou (CN); Min Wei, Suzhou (CN); Fuping Cheng, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 398 days.

This patent is subject to a terminal disclaimer.

(21) Appl. No.: 18/560,089

(22) PCT Filed: Feb. 23, 2022

(86) PCT No.: PCT/CN2022/077462

§ 371 (c)(1),
(2) Date: Nov. 9, 2023

(87) PCT Pub. No.: WO2022/237270

PCT Pub. Date: Nov. 17, 2022

(65) Prior Publication Data

US 2024/0349963 A1 Oct. 24, 2024

(30) Foreign Application Priority Data

May 10, 2021 (CN) ..... 202110506521.4

(51) Int. Cl.
*A47L 9/04* (2006.01)

(52) U.S. Cl.
CPC ..... *A47L 9/0444* (2013.01); *A47L 9/0411* (2013.01); *A47L 9/0433* (2013.01); *A47L 9/0455* (2013.01); *A47L 9/0477* (2013.01)

(58) Field of Classification Search
CPC .... A47L 9/0411; A47L 9/0433; A47L 9/0444; A47L 9/0455; A47L 9/0477
See application file for complete search history.

(56) References Cited

U.S. PATENT DOCUMENTS

2019/0254494 A1 8/2019 Hyu et al.
2020/0245831 A1* 8/2020 Peng ..... A47L 9/242
(Continued)

FOREIGN PATENT DOCUMENTS

CN 202313115 U 7/2012
CN 208582328 U 3/2019
(Continued)

OTHER PUBLICATIONS

The First Office Action received in the counterpart CA application 3,218,355, mailed on Mar. 17, 2025, 3 pages.
(Continued)

*Primary Examiner* — Andrew J Marien
(74) *Attorney, Agent, or Firm* — K&L Gates LLP

(57) ABSTRACT

Provided are a floor brush assembly for a vacuum cleaner and the vacuum cleaner. The floor brush assembly includes a roller brush component and a driving mechanism. The roller brush component includes a sleeve and a roller brush body rotatably mounted in the sleeve. The roller brush body is provided with bristles. The driving mechanism includes a power source and a transmission component. The transmission component includes a first driving member, a second driving member, and a driving wheel connected to the power source. The driving wheel is connected to the first driving member through a transmission shaft to drive the roller
(Continued)

brush body to rotate. The driving wheel is connected to the second driving member through a linkage structure to drive the sleeve to rotate. The first driving member and the second driving member are eccentrically arranged to allow the bristles to be selectively extended out of or retracted into the sleeve.

18 Claims, 6 Drawing Sheets

(56) References Cited

U.S. PATENT DOCUMENTS

| | | | | |
|---|---|---|---|---|
| 2021/0186291 | A1* | 6/2021 | Nguyen | A47L 9/325 |
| 2023/0051802 | A1* | 2/2023 | Xu | A46B 17/06 |

FOREIGN PATENT DOCUMENTS

| | | | |
|---|---|---|---|
| CN | 110731728 | A | 1/2020 |
| CN | 110897551 | A | 3/2020 |
| CN | 211704445 | U | 10/2020 |
| CN | 211796207 | U | 10/2020 |
| CN | 211961925 | U | 11/2020 |
| CN | 113229743 | A | 8/2021 |
| CN | 113229744 | A | 8/2021 |
| CN | 113229746 | A | 8/2021 |
| CN | 215078006 | U | 12/2021 |
| JP | S5953120 | A | 3/1984 |
| JP | S62130123 | A | 6/1987 |
| JP | 2002272654 | A | 9/2002 |

OTHER PUBLICATIONS

The Grant Notice received in the counterpart EP application 22806247.7, mailed on May 9, 2025, 40 pages.

The Decision to Grant a Patent received in the counterpart JP application 2023-569981, 5 pages with English translation.

International Search Report received in PCT/CN2022/077462; mailed May 26, 2022.

First OA Received in CN Application No. 202110506521.4; mailed Mar. 3, 2022.

* cited by examiner

FLOOR BRUSH ASSEMBLY FOR VACUUM CLEANER, AND VACUUM CLEANER

CROSS-REFERENCES TO RELATED APPLICATIONS

The present disclosure is a national phase application of International Application No. PCT/CN2022/077462, filed on Feb. 23, 2022, which claims priority to Chinese Patent Application No. 202110506521.4 filed on May 10, 2021, the entireties of which are herein incorporated by reference.

FIELD

The present disclosure relates to the field of household appliance manufacturing, and more particularly, to a floor brush assembly for a vacuum cleaner and a vacuum cleaner having the same.

BACKGROUND

Currently, a vacuum cleaner is gradually widely used, which greatly facilitates household cleaning and alleviates an intensity of housework for a user. However, the vacuum cleaner needs to perform a self-dust cleaning operation after dust removal operation, a roller brush body is often tangled with hair, threads, and other elongated objects, obstructing a rotation of the roller brush body. Therefore, manual cleaning is required. In the related art, a drive structure for the roller brush body and a sleeve of the vacuum cleaner employs a gear transmission structure, which requires high assembly precision. In addition, when a roller brush cannot rotate due to blockage, once jerking of a belt occurs, the operation would easily be stopped. In this case, misalignment would occur on assembling between the roller brush body and the sleeve. Therefore, an improvement on the vacuum cleaner is required.

SUMMARY

The present disclosure aims to at least solve one of the problems existing in the related art. To this end, according to embodiments of the present disclosure, there is provided a floor brush assembly for a vacuum cleaner. In the floor brush assembly, a roller brush body and a sleeve can be eccentrically driven by a driving wheel and a corresponding driving member of the floor brush assembly via a transmission shaft and a linkage structure. Therefore, a structure is simple, and too compact structural arrangement can be avoided. In addition, the requirement for assembly precision is low.

A floor brush assembly for a vacuum cleaner according to an embodiment of the present disclosure includes a roller brush component and a driving mechanism. The roller brush component includes a sleeve and a roller brush body rotatably mounted in the sleeve. The roller brush body is provided with bristles. The driving mechanism includes a power source and a transmission component. The transmission component includes a first driving member, a second driving member, and a driving wheel connected to the power source. The driving wheel is connected to the first driving member through a transmission shaft to drive the roller brush body to rotate. The driving wheel is connected to the second driving member through a linkage structure to drive the sleeve to rotate. The first driving member and the second driving member are eccentrically arranged to allow the bristles to be selectively extended out of or retracted into the sleeve.

In the floor brush assembly for the vacuum cleaner according to the embodiment of the present disclosure, the first driving member and the second driving member are eccentrically arranged to allow the bristles to selectively be extended out of or retracted into the sleeve, which can solve a problem in which the roller brush body becomes tangled with elongated objects such as hair and threads. In addition, a belt pulley and two driving members are in transmission cooperation with each other in the form of the transmission shaft and the linkage structure, which is beneficial to lowering requirements for the assembly precision, to improve mounting efficiency and reducing component wear during transmission. In one embodiment, un-rotation due to jerking of the belt can be avoided. Therefore, it is possible to avoid misalignment between the roller brush and the sleeve, to improve overall performance of the floor brush assembly.

In the floor brush assembly for the vacuum cleaner according to some embodiments of the present disclosure, the driving wheel has a first transmission hole and a second transmission hole located at a radial outer side of the first transmission hole. The second driving member has an avoidance hole and a third transmission hole located at a radial outer side of the avoidance hole. The transmission shaft passes through the first transmission hole and is relatively fixed to the driving wheel circumferentially. The transmission shaft passes through the avoidance hole to be connected to the first driving member. The linkage structure has an end extending into the second transmission hole to be rotatably engaged with the driving wheel and another end extending into the third transmission hole to be rotatably engaged with the second driving member.

In the floor brush assembly for the vacuum cleaner according to some embodiments of the present disclosure, an axis of the first transmission hole is coincident with a rotation axis of the driving wheel. An axis of the avoidance hole is coincident with a rotation axis of the second driving member. An axis of the transmission shaft is offset from the axis of the avoidance hole.

In the floor brush assembly for the vacuum cleaner according to some embodiments of the present disclosure, the linkage structure includes a first link, a connection block, and a second link. The first link and the second link are respectively connected to two ends of the connection block and extend away from each other from two sides of the connection block. The first link extends into the second transmission hole, and the second link extends into the third transmission hole.

In the floor brush assembly for the vacuum cleaner according to some embodiments of the present disclosure, second transmission holes is provided and arranged at intervals around the first transmission hole. Third transmission holes is provided and arranged at intervals around the avoidance hole. Linkage structures is provided. The linkage structures, second transmission holes, and third transmission holes are arranged in one-to-one correspondence.

In the floor brush assembly for the vacuum cleaner according to some embodiments of the present disclosure, second transmission holes is evenly arranged at intervals in a circumferential direction of the first transmission hole, and third transmission holes is evenly arranged at intervals in a circumferential direction of the avoidance hole.

In the floor brush assembly for the vacuum cleaner according to some embodiments of the present disclosure, the transmission component further includes a bearing support block rotatably supported at the second driving member. The bearing support block has an eccentric hole. An axis of the eccentric hole is offset from the axis of the avoidance hole, and the transmission shaft is rotatably supported at the eccentric hole.

In the floor brush assembly for the vacuum cleaner according to an embodiment of the present disclosure, the floor brush assembly further includes a motor support connected to the power source, and a driving side end cover detachably mounted at the motor support. An end of the transmission shaft away from the roller brush body is rotatably supported at the driving side end cover, and the second driving member is rotatably supported at the motor support.

In the floor brush assembly for the vacuum cleaner according to an embodiment of the present disclosure, the first driving member is provided with first driving teeth at a side of the first driving member facing towards the roller brush body. The roller brush body is provided with first driven teeth at a side of the roller brush body facing towards the first driving member. The first driving teeth are engaged with the first driven teeth. The second driving member is provided with second driving teeth at a side of the second driving member facing towards the sleeve. The sleeve is provided with second driven teeth at a side of the sleeve facing towards the second driving member. The second driving teeth are engaged with the second driven teeth.

According to some embodiments of the present disclosure, there is also provided a vacuum cleaner.

The vacuum cleaner according to some embodiments of the present disclosure includes the floor brush assembly according to any one of the above embodiments.

Compared with the related art, the vacuum cleaner has the same advantages as the floor brush assembly, and details thereof will be omitted herein.

Additional embodiments of the present disclosure will be set forth, in part, from the following description, and in part will become apparent from the following description, or may be learned by practice of the present disclosure.

BRIEF DESCRIPTION OF THE DRAWINGS

The above and/or additional embodiments of the present disclosure will become apparent and readily understood from the following description of embodiments in conjunction with the accompanying drawings, in which.

Figure 1:
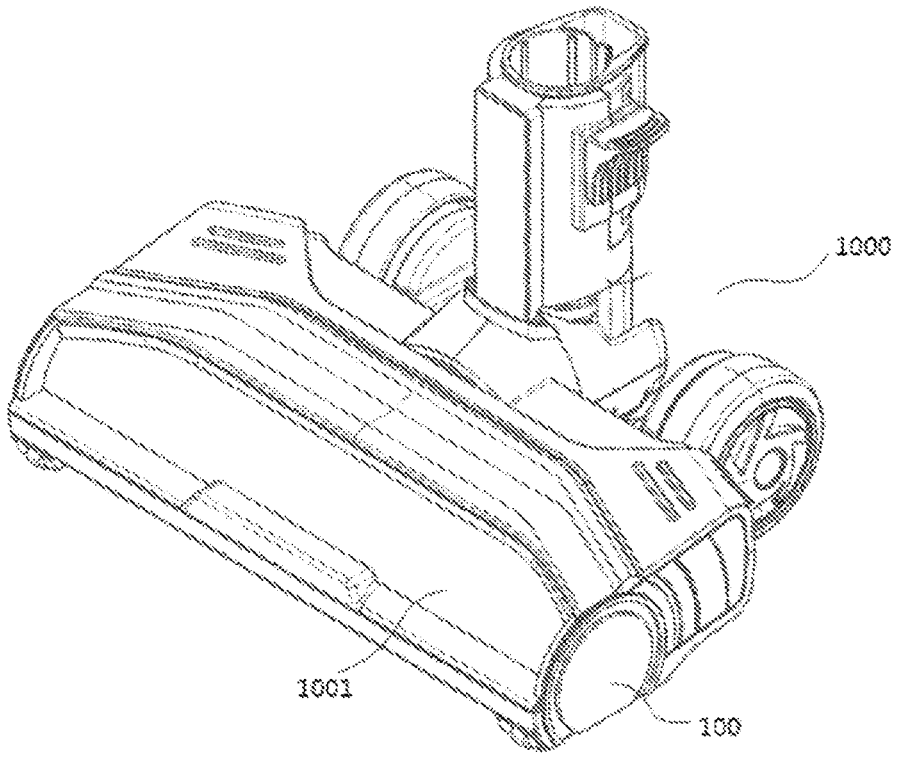
FIG. 1 is a schematic structural view of a vacuum cleaner according to an embodiment of the present disclosure.

REFERENCE NUMERALS vacuum cleaner 1000, floor brush assembly 100, roller brush component 1, roller brush body 11, first driven tooth 111, bristles 112, brush body structure 113, driven shaft 114, sleeve 12, second driven tooth 121, avoidance opening 122, driving mechanism 2, transmission component 21, driving wheel 22, first transmission hole 221, second transmission hole 222, first driving member 23, first driving tooth 231, second driving member 24, transmission portion 241, support connection portion 242, second driving tooth 243, avoidance hole 244, third transmission hole 245, transmission shaft 25, linkage structure 26, first link 261, connection block 262, second link 263, bearing support block 27, eccentric hole 271, driving casing 28, motor support 281, driving side end cover 282, power source 29, driving wheel 291, belt 3, bearing 4, driven side end cover 5, housing 1001, roller brush upper cover 1002, bottom plate 1003.

DETAILED DESCRIPTION OF THE DISCLOSURE

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain, rather than limiting the present disclosure.

A floor brush assembly 100 according to an embodiment of the present disclosure will be described below with reference to FIG. 1 to FIG. 7. A first driving member 23 is driven by a part of driving force output from a power source 29 of the floor brush assembly 100 at a driving wheel 22 through a transmission shaft 25, to drive a roller brush body 11 to rotate. Further, a second driving member 24 is driven by another part of the driving force through a linkage structure 26, to drive a sleeve 12 to rotate. In this way, the roller brush body 11 and the sleeve 12 can be driven independently. In one embodiment, during this transmission, transmission of power does not need to be performed by using two belt pulleys through a gear engagement structure as in traditional technology. Therefore, a reduction in requirements for engagement precision among various components is facilitated. In one embodiment, excessive wear of a gear transmission structure can be avoided. It is especially less prone to assembly misalignment, to enhance practicability of the floor brush assembly 100.

Figure 2:
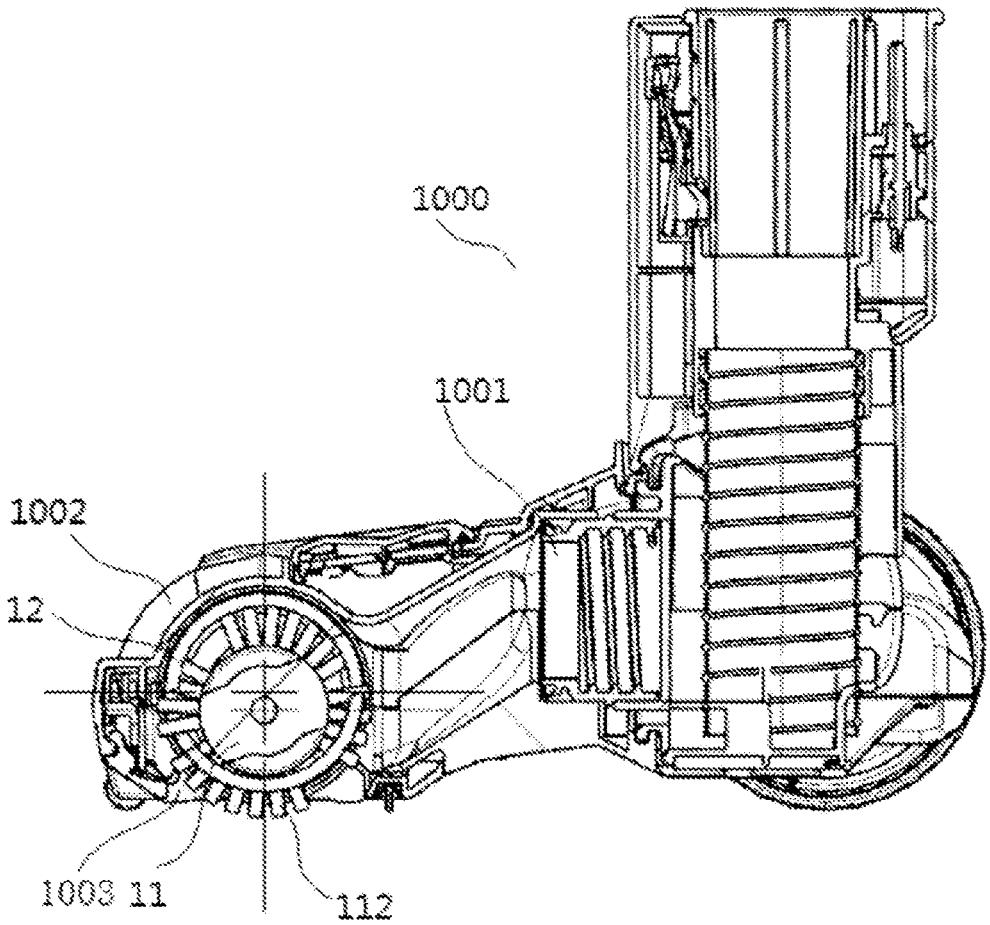
FIG. 2 is a side view of a vacuum cleaner according to an embodiment of the present disclosure.

It should be noted that the floor brush assembly 100 according to some embodiments of the present disclosure may be integrally mounted in a housing 1001 of a vacuum cleaner 1000. FIG. 1 illustrates a schematic structural view of a vacuum cleaner 1000 according to an embodiment of the present disclosure. As illustrated in FIG. 1, the floor brush assembly 100 is mounted at a bottom of the vacuum cleaner 1000. As illustrated in FIG. 2, the floor brush assembly 100 is located at a bottom of the vacuum cleaner 1000 at a front side of the vacuum cleaner 1000. As illustrated in FIG. 2, a bottom of the housing 1001 of the vacuum cleaner 1000 at a front side of the housing 1001 is open to form a cleaning opening in a region of the bottom of the housing 1001 at the front side of the housing 1001. Bristles 112 of a roller brush component 1 of the floor brush assembly 100 may extend from the cleaning opening and can clean a surface to be cleaned. For example, the surface to be cleaned may be the ground. In this way, the bristles 112 can sweep debris, hair, or the like on the ground, and cooperate with a dust collector assembly of the vacuum cleaner 1000 to suck and collect the debris and hair, to achieve an effect of cleaning the ground.

Further, during mounting, as illustrated in FIG. 2, the vacuum cleaner 100 is provided with a roller brush upper cover 1002 at a top of a front part of the vacuum cleaner 1000. A bottom plate 1003 is provided at a bottom of the front part of the vacuum cleaner 1000. The roller brush upper cover 1002 is spaced apart from the bottom plate 1003 in an up-down direction to define a mounting space between the roller brush upper cover 1002 and the bottom plate 1003. In addition, the bottom plate 1003 has a cleaning opening. The floor brush assembly 100 is mounted in the mounting space. Further, the bristles 112 pass through the cleaning opening at the bottom plate 1003 to clean the ground.

Figure 3:
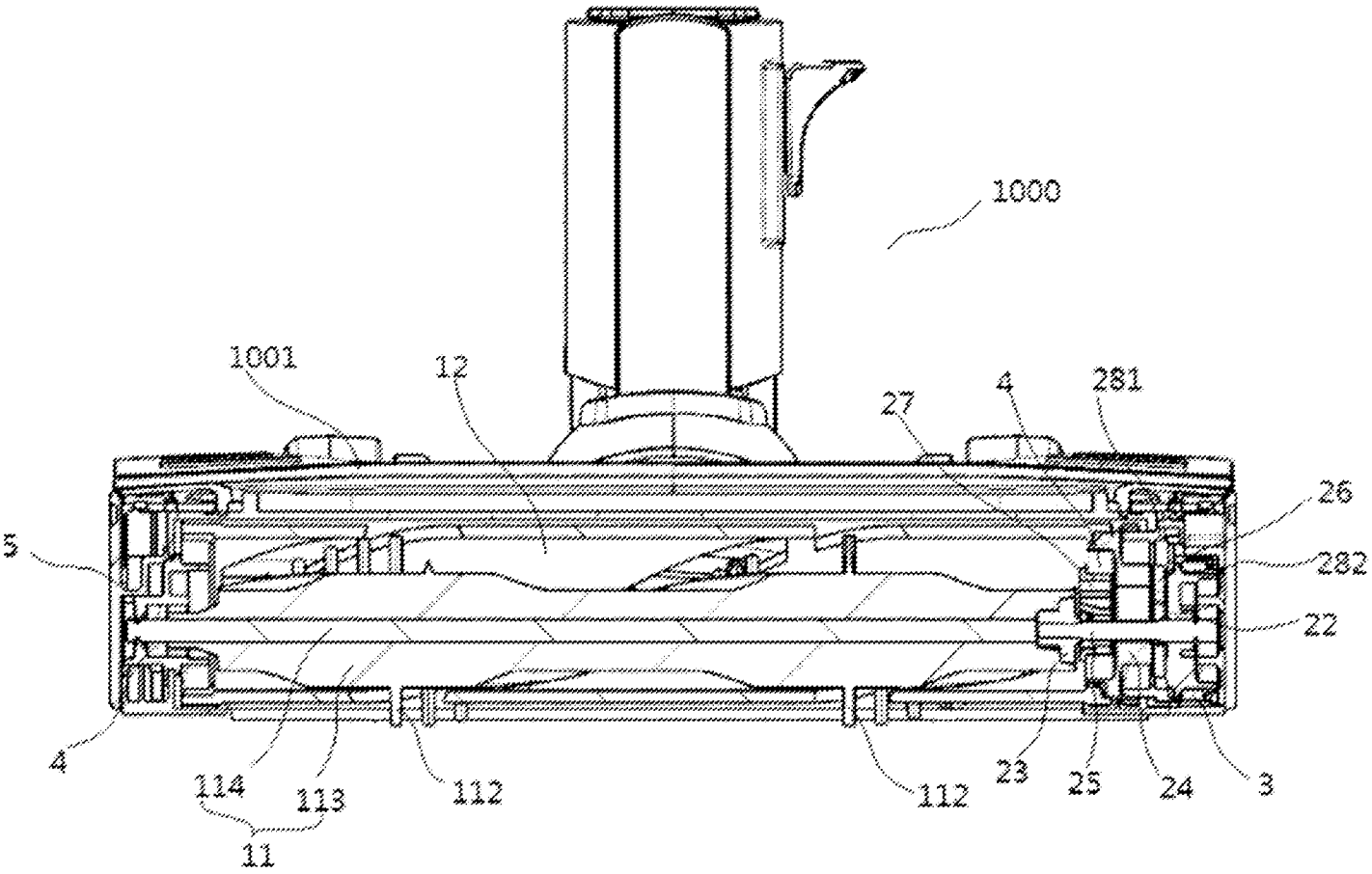
FIG. 3 is a schematic cross-sectional view of a vacuum cleaner at a floor brush assembly according to an embodiment of the present disclosure.
Figure 4:
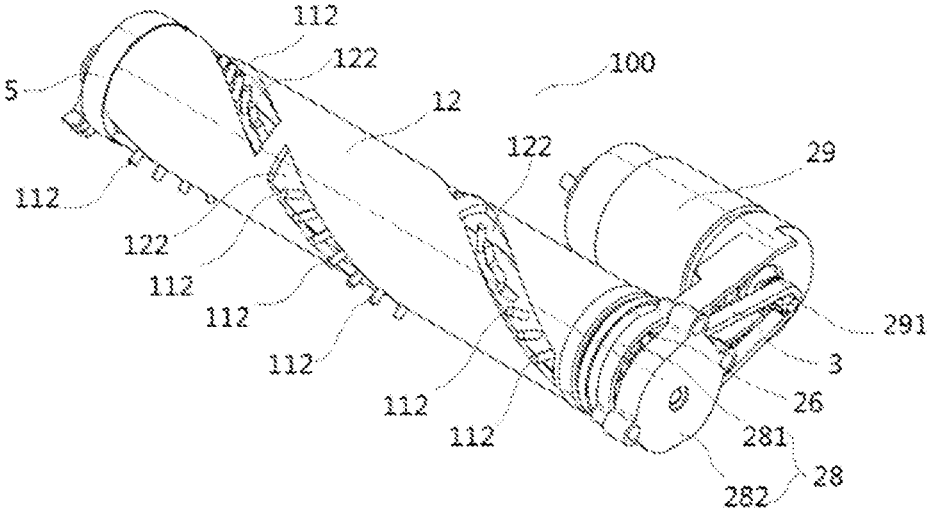
FIG. 4 is a schematic structural view of a floor brush assembly according to an embodiment of the present disclosure.

As illustrated in FIG. 3 and FIG. 4, the floor brush assembly 100 according to an embodiment of the present disclosure includes a roller brush component 1 and a driving mechanism 2. The driving mechanism 2 and the roller brush component 1 are both mounted in the housing 1001. Further, the driving mechanism 2 is fixedly connected to the housing 1001, and the roller brush component 1 is rotatably supported in the housing 1001 to be connected to an output end of the driving mechanism 2. As a result, a driving force at the driving mechanism 2 can be output to the roller brush component 1. Therefore, the roller brush component 1 can be driven by the driving mechanism 2 to rotate relative to the housing 1001. In this way, during rotation of the roller brush component 1, the bristles 112 of the roller brush component 1 can be extended from the cleaning opening for cleaning the surface to be cleaned.

Figure 7:
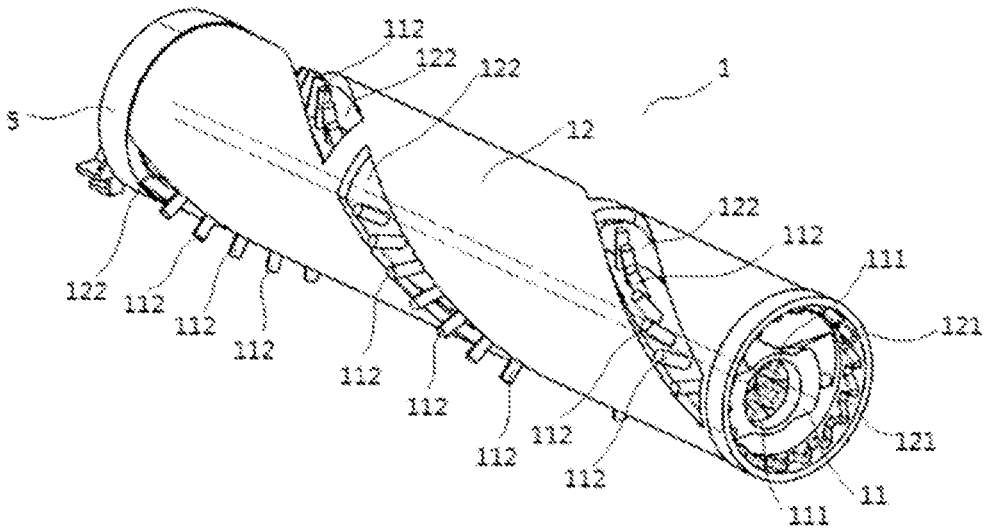
FIG. 7 is a schematic structural view of a roller brush component of a driving mechanism of a floor brush assembly according to an embodiment of the present disclosure.

As illustrated in FIG. 3, the roller brush component 1 includes a sleeve 12 and a roller brush body 11. A left end of the sleeve 12 is rotatably supported in the housing 1001 of the vacuum cleaner 1000, and a right end of the sleeve 12 (the right end illustrated in FIG. 3 is only used for ease of description and does not limit actual mounting) is mounted to the output end of the driving mechanism 2, enabling the sleeve 12 to be driven by the driving mechanism 2 from the right end of the sleeve 12 to rotate relative to the housing 1001. The sleeve 12 has an internal mounting space, and the roller brush body 11 is rotatably mounted in the sleeve 12. In addition, as illustrated in FIG. 3, the roller brush body 11 includes an external brush body structure 113 and a driven shaft 114 integrated inside the brush body structure 113. Further, the brush body structure 113 and the driven shaft 114 are integrated into one piece to rotate together relative to the sleeve 12. As illustrated in FIG. 3, a left end of the driven shaft 114 is rotatably supported at the left end of the sleeve 12 through a bearing 4. As illustrated in FIG. 7, a driven side end cover 5 is provided at the left end of the sleeve 12, and the left end of the driven shaft 114 is supported at the driven side end cover 5 through the bearing 4. Further, a right end of the brush body structure 113 is in power connection with the driving mechanism 2. Therefore, the roller brush body 11 can be driven by the driving mechanism 2 to rotate.

Here, as illustrated in FIG. 4 and FIG. 7, the roller brush body 11 is provided with bristles 112. The bristles 112 are arranged at an outer peripheral wall of the roller brush body 11. The bristles 112 protrude and extend from the outer peripheral wall of the roller brush body 11 radially. An avoidance opening 122 is formed at an outer peripheral wall of the sleeve 12. The avoidance opening 122 penetrates the outer peripheral wall of the sleeve 12 in a radial direction of the sleeve 12. During rotation of the roller brush body 11 in the sleeve 12, the bristles 112 can extend from the avoidance opening 122 for cleaning a cleaning surface.

The driving mechanism 2 includes a power source 29 and a transmission component 21. The transmission component 21 includes a driving wheel 22, a first driving member 23, and a second driving member 24. The driving wheel 22 is connected to the power source 29. The power source 29 may be configured as a drive motor, and the driving wheel 22 may be configured as a belt pulley. Further, a driving wheel 291 is provided at a motor shaft of the drive motor. A rotation axis of the belt pulley is parallel to a rotation axis of the driving wheel 291, and the belt pulley and the driving wheel 291 are arranged directly facing towards each other radially. In this way, the driving wheel 291 is in transmission engaged with the belt pulley through a belt 3, enabling a driving force output by the drive motor to be transferred to the belt pulley through the belt 3 at the driving wheel 291 and then to be distributed towards the first driving member 23 and the second driving member 24 through the belt pulley.

Figure 6:
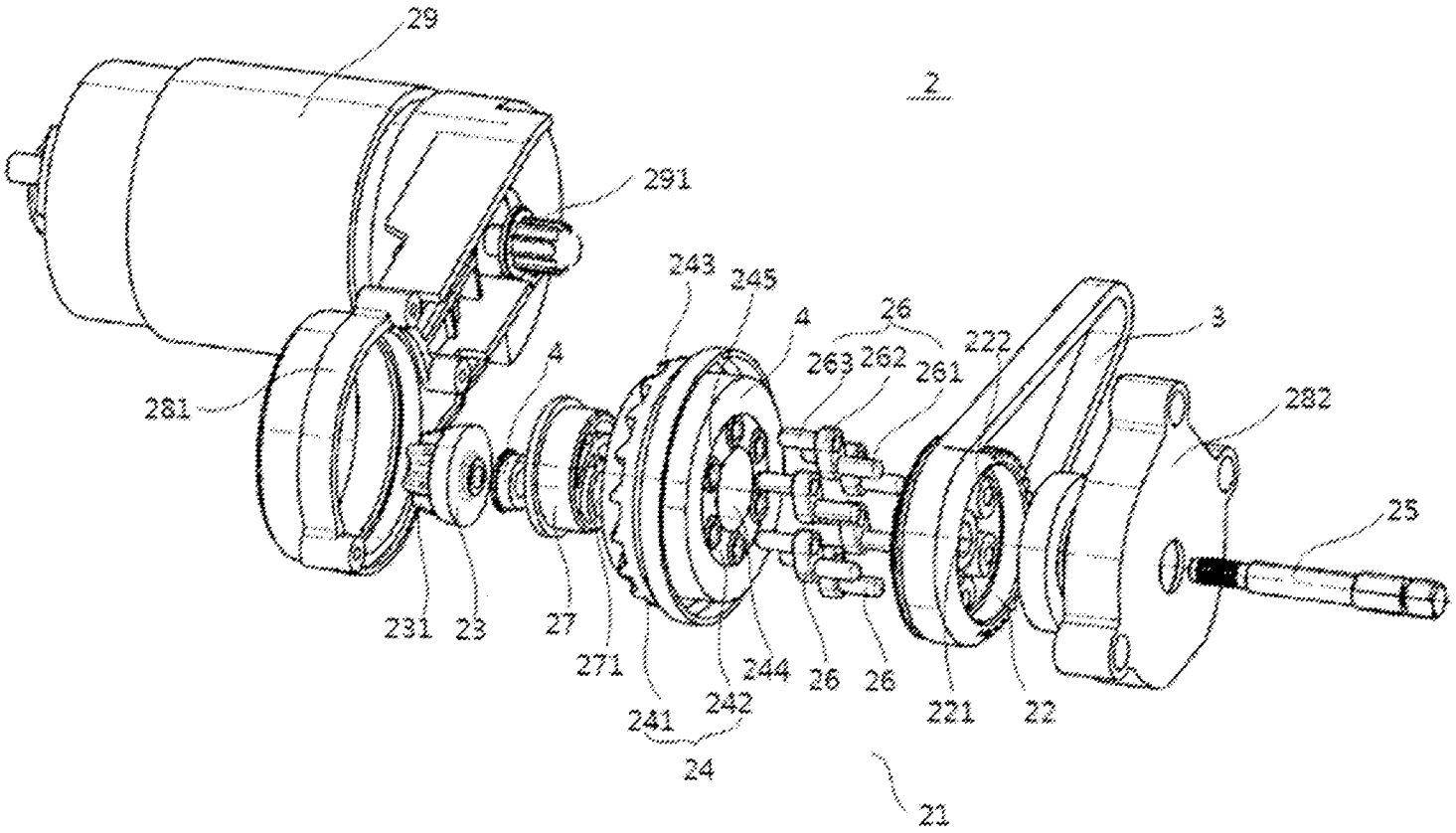
FIG. 6 is an exploded view of a driving mechanism of a floor brush assembly according to an embodiment of the present disclosure.

Here, the driving wheel 22 is connected to the first driving member 23 through a transmission shaft 25 to drive the roller brush body 11 to rotate. The driving wheel 22 is connected to the second driving member 24 through a linkage structure 26 to drive the sleeve 12 to rotate. Further, as illustrated in FIG. 6, the first driving member 23 is constructed as a circular block, allowing the first driving member 23 to have its own rotation axis and to rotate around its own rotation axis. The second driving member 24 is constructed as a circular block, allowing the second driving member 24 to have its own rotation axis and to rotate around its own rotation axis. Furthermore, as illustrated in FIG. 3, the first driving member 23 is in direct contact engagement with a right end of the roller brush body 11 and can drive the roller brush body 11 to rotate, and the second driving member 24 is in direct contact engagement with the right end of the sleeve 12 and can drive the sleeve 12 to rotate. That is, a part of a driving force from the drive motor is output to the first driving member 23 through the transmission shaft 25 at the belt pulley, allowing the roller brush body 11 to rotate in the sleeve 12. In addition, another part of the driving force is output to the second driving member 24 through the linkage structure 26, allowing the sleeve 12 to rotate relative to the housing 1001.

Therefore, the belt pulley and two driving members are in transmission cooperation with each other in the form of the transmission shaft 25 and the linkage structure 26, respectively. That is, a transmission structure between the belt pulley and the two driving members in the present disclosure is not designed with a traditional gear transmission structure. In this way, not only assembly precision requirements between the pulley and the two driving members can be reduced, to lower assembly difficulty, but also the excessive wear existing in gear transmission can be avoided, which can easily prolong a service life of the driving mechanism 2. Meanwhile, through the cooperation between the transmission shaft 25 and the linkage structure 26, driving can be implemented by one driving wheel 22, and has no problem of superabundant requirements for a mounting space of a dual belt pulley. In addition, unrotation due to the jerking of the belt 3 can be avoided. Therefore, occurrence of a misalignment of the assembling between the roller brush and the sleeve 12 can be avoided, which greatly improves reliability and safety of the floor brush assembly 100.

The first driving member 23 and the second driving member 24 are eccentrically arranged to allow the bristles 112 to be selectively extended out of or retracted into the sleeve 12. That is, when the roller brush body 11 is driven by the first driving member 23 to rotate and the sleeve 12 is driven by the second driving member 24, an axis of the roller brush body 11 is offset from an axis of the sleeve 12. It should be noted that, as illustrated in FIG. 3, a rotation axis of the roller brush body 11 is lower than a rotation axis of the sleeve 12, and the bristles 112 are provided at each of different positions on the outer peripheral wall of the roller brush body 11. Meanwhile, different avoidance openings 122 is provided at the outer peripheral wall of the sleeve 12. In this way, when the bristles 112 at the outer peripheral wall of the roller brush body 11 and the avoidance openings 122 of the sleeve 12 are both located in a lower region, the bristles 112 at the lower region can be extended downwards from the avoidance opening 122 for cleaning the surface to be cleaned. In one embodiment, when the bristles 112 at the outer peripheral wall of the roller brush body 11 and the avoidance openings 122 of the sleeve 12 are both located in an upper region, the bristles 112 at the upper region can be retracted into the sleeve 12 through the avoidance opening 122.

Therefore, more the bristles 112 and the avoidance opening 122 may be provided for the cooperation therebetween, which enables bristles 112 at a bottom of the floor brush assembly 100 always to be extended from the avoidance opening 122, continuously cleaning the ground. Therefore, cleanliness of the vacuum cleaner 1000 can be ensured.

It can be understood that when the bristles 112 is extended from the sleeve 12, the bristles 112 can clean the ground. In addition, when the bristles 112 are retracted into the sleeve 12, debris at the bristles 112 can be separated from the bristles 112 under an action of an opening wall of the avoidance opening 122. In this way, excessive debris entangled at the bristles 112 are prevented from affecting normal rotation of the roller brush body 11. Therefore, a reduction in cleaning difficulty of the bristles 112 is facilitated, which obviates the need for a user for manual cleaning and improves the practicability. In addition, a problem of winding the roller brush body 11 by elongated objects like hair and threads can be solved.

In the floor brush assembly 100 for the vacuum cleaner according to some embodiments of the present disclosure, the first driving member 23 and the second driving member 24 are eccentrically arranged to allow the bristles 112 to be selectively extended out of or retracted into the sleeve 12, the problem in which the roller brush body 11 becomes entangled with elongated objects such as hair and threads can be solved. In addition, the belt pulley and the two driving members are in transmission cooperation with each other in the form of the transmission shaft 25 and the linkage structure 26, which is beneficial to lowering requirements for assembly precision and improving the mounting efficiency. Therefore, component wear during the transmission is less. In one embodiment, the un-rotation due to the jerking of the belt 3 can be avoided. Therefore, the misalignment of the assembling between the roller brush and the sleeve 12 is avoided, and the overall performance of the floor brush assembly 100 is enhanced.

In some embodiments, the driving wheel 22 has a first transmission hole 221 and a second transmission hole 222. As illustrated in FIG. 6, the driving wheel 22 may be constructed as the belt pulley, and the belt 3 is mounted at an outer peripheral wall of the driving wheel 22 and is configured to be in transmission engagement with the driving wheel 291 of the drive motor. In addition, the first transmission hole 221 is formed at a center of the driving wheel 22 and penetrates the driving wheel 22 in an axial direction of the driving wheel 22. An axis of the first transmission hole 221 is coincident with an axis of the belt pulley. In this way, when the belt pulley rotates, the belt pulley rotates around the axis of the first transmission hole 221. The second driving member 24 has an avoidance hole 244 and a third transmission hole 245. The avoidance hole 244 is located at a center of the second driving member 24 and penetrates the second driving member 24 in an axial direction of the second driving member 24. An axis of the avoidance hole 244 is coincident with an axis of the second driving member 24.

Here, the transmission shaft 25 passes through the first transmission hole 221 and is relatively fixed to the driving wheel 22 circumferentially. Further, the transmission shaft 25 passes through the avoidance hole 244 to be connected to the first driving member 23. That is, the transmission shaft 25 may be circumferentially fixed to the belt pulley at the first transmission hole 221, enabling the transmission shaft 25 to be driven by the belt pulley to rotate. In an exemplary design, the first transmission hole 221 may have a polygonal surface, and the transmission shaft 25 is designed as a multi-prism structure at a position where the transmission shaft 25 is engaged with the first transmission hole 221, enabling the transmission shaft 25 to rotate under the action of an inner peripheral wall of the first transmission hole 221. For example, the first transmission hole 221 is designed to be a hexagonal hole, and the transmission shaft 25 is designed to be a hexagonal prism at a corresponding position. The transmission shaft 25 may be limited and engaged with the first transmission hole 221 through a spline structure, or one of an outer peripheral wall of the transmission shaft 25 and the inner peripheral wall of the first transmission hole 221 is provided with a limiting boss, and another one of the outer peripheral wall of the transmission shaft 25 and the inner peripheral wall of the first transmission hole 221 has a limiting groove. In one embodiment, the limiting boss extends into the limiting groove radially to achieve a circumferential limiting between the transmission shaft 25 and the belt pulley.

As illustrated in FIG. 6, the second transmission hole 222 is located at a radial outer side of the first transmission hole 221 on the belt pulley. That is, an axis of the second transmission hole 222 is offset from the rotation axis of the belt pulley. In one embodiment, the third transmission hole 245 is located at a radial outer side of the avoidance hole 244 on the second driving member 24. That is, an axis of the third transmission hole 245 is offset from a rotation axis of the second driving member 24. An end of the linkage structure 26 extends to the second transmission hole 222 to be rotatably engaged with the driving wheel 22, and another end of the linkage structure 26 extends into the third transmission hole 245 to be rotatably engaged with the second driving member 24.

In some embodiments, as illustrated in FIG. 6, a right end of the linkage structure 26 and the second transmission hole 222 are arranged directly facing towards each other in an axial direction of the belt pulley, and the right end of the linkage structure 26 may extend into the second transmission hole 222. An outer peripheral wall of the right end of the linkage structure 26 is rotatably engaged with an inner peripheral wall of the second transmission hole 222. Meanwhile, a left end of the linkage structure 26 and the third transmission hole 245 are arranged directly facing towards each other in the axial direction of the second driving member 24, and the left end of the linkage structure 26 extends into the third transmission hole 245. In one embodiment, projections of the two ends of the linkage structure 26 in the axial direction of the second driving member 24 are offset from each other. In this way, the rotation axis of the belt pulley may be offset from the rotation axis of the second driving member 24.

It should be noted that, as illustrated in FIG. 6, the avoidance hole 244 is a central hole of the second driving member 24, and the first transmission hole 221 is a central hole of the belt pulley. In one embodiment, a diameter of the avoidance hole 244 is greater than a diameter of the first transmission hole 221. In this way, when the transmission shaft 25 passes through the avoidance hole 244, the transmission shaft 25 may be constructed to allow its own axis to be offset from the axis of the avoidance hole 244, allowing the transmission shaft 25 and the second driving member 24 to be eccentrically arranged. As illustrated in FIG. 3, a left end of the transmission shaft 25 is connected to the first driving member 23, the first driving member 23 is in power connection with the right end of the roller brush body 11, and the transmission shaft 25 is located at a lower region in the avoiding hole 244, allowing a rotation axis of the first driving member 23 to deviate downwards relative to a rotation axis of a second drive shaft. In this way, during the rotation of the roller brush body 11, the bristles 112 of the roller brush body 11 can be extended from the avoidance opening 122 of the sleeve 12 at the lower part of the sleeve 12.

In the present disclosure, through the design of the linkage structure 26 and the transmission shaft 25, the axis of the first transmission hole 221 is coincident with a rotation axis of the driving wheel 22, the axis of the avoidance hole 244 is coincident with the rotation axis of the second driving member 24, and an axis of the transmission shaft 25 is offset from the axis of the avoidance hole 244.

In this way, in a process in which the roller brush body 11 is driven by the first driving member 23 to rotate relative to the sleeve 12, the rotation axis of the first driving member 23 is offset from the rotation axis of the second driving member 24, making the rotation axis of the sleeve 12 be offset from the rotation axis of the roller brush body 11 and realizing eccentric rotation between the roller brush body 11 and the sleeve 12. Therefore, the transmission structure in the present disclosure dispenses with a need for providing a dual drive structure to cooperate with two groups of gear structures, i.e., can realize eccentric rotation of the roller brush body 11 relative to the sleeve 12. In addition, the structure is simple, the installation is convenient, and the requirement for mounting precision is greatly reduced. Therefore, it is possible to improve assembly efficiency.

In some embodiments, the linkage structure 26 includes a first link 261, a connection block 262, and a second link 263. The first link 261, the connection block 262, and the second link 263 may be integrally formed, or may be fixedly connected to each other. As illustrated in FIG. 6, the first link 261 is a circular link, and the second link 263 is also constructed as a circular link. In one embodiment, a length of the first link 261 is the same as a length of the second link 263. The connection block 262 is constructed into a rectangular blocky shape, and each of an upper end and a lower end of the connection block 262 has a circular hole. The circular hole penetrates the connection block 262 in the axial direction of the second driving member 24. That is, the circular hole penetrates the connection block 262 from a left side to a right side of the connection block 262.

The first link 261 and the second link 263 are respectively connected to two ends of the connection block 262 and extend away from each other from two sides of the connection block 262. The first link 261 extends into the second transmission hole 222, and the second link 263 extends into the third transmission hole 245. As illustrated in FIG. 6, the first link 261 is connected to the lower end of the connection block 262 and extends rightwards from a right side surface of the connection block 262, allowing a right end of the first link 261 to extend into the second transmission hole 222 to be in transmission engagement with the belt pulley. Meanwhile, the second link 263 is connected to an upper end of the connection block 262, and the second link 263 extends leftwards from a left side surface of the connection block 262, allowing a left end of the second link 263 to extend into the third transmission hole 245 to be in transmission engagement with the second driving member 24.

In the present disclosure, the linkage structure 26 is arranged between the belt pulley and the second driving member 24, and the linkage structure 26 has the characteristic in which an axis of the first link 261 is offset from an axis of the second link 263, which can achieve power transmission on different axes, enabling the belt pulley and the second driving member 24 to rotate around different rotation axes, respectively. In this way, the first driving member 23 may be driven by the belt pulley to eccentrically rotate relative to the second driving member 24, further realizing the eccentric rotation of the roller brush body 11 relative to the sleeve 12.

It should be noted that, compared with eccentric transmission implemented by engaging two sets of gear structures of different sizes in the traditional design, an arrangement of the linkage structure 26 in the present disclosure has a simple mounting structure and low assembly precision. In one embodiment, the design using the linkage structure 26 for transmission is less prone to risks of loud noise and quick wear, and reduction of transmission efficiency and excessive wear caused by relative sliding friction between gear contours can be avoided, to provide better practicability.

In some embodiments, second transmission holes 222 is provided and arranged at intervals around the first transmission hole 221. Linkage structures 26 is provided. linkage structures 26, second transmission holes 222, and third transmission holes 245 are arranged in one-to-one correspondence. In this way, the first link 261 and the second link 263 of linkage structures 26 may respectively extend into second transmission holes 222 and third transmission holes 245 in one-to-one correspondence, allowing the belt pulley to be in power connection and engagement with the second driving member 24 at several positions. Therefore, it is beneficial to improve stability of power transmission between the belt pulley and the second driving member 24. In one embodiment, the transmission of greater power torque is facilitated.

Here, as illustrated in FIG. 6, the first transmission hole 221 is located at a center of the belt pulley, and six second transmission holes 222 are formed and arranged at intervals in a circumferential direction of the belt pulley to be distributed around the first transmission hole 221. The driving wheel 22 has third transmission holes 245 arranged at intervals around the avoidance hole 244. As illustrated in FIG. 6, the avoidance hole 244 is located at the center of the belt pulley, and six third transmission holes 245 are provided and arranged at intervals in the circumferential direction of the belt pulley to be distributed around the avoidance hole 244.

Here, as illustrated in FIG. 6, six linkage structures 26 are provided and arranged at intervals in a circumferential direction of the second driving member 24. The right ends of the first links 261 of the six linkage structures 26 and the six second transmission holes 222 of the belt pulley are arranged directly facing towards each other in the axial direction of the belt pulley in one-to-one correspondence, enabling the driving force to be partially transferred to the six linkage structures 26 by the belt pulley through inner walls of the six second transmission holes 222. Meanwhile, the left ends of the second links 263 of the six linkage structures 26 and the six third transmission holes 245 of the second driving member 24 are arranged directly facing towards each other in the axial direction of the second driving member 24 in one-to-one correspondence, allowing the driving force to be transferred to the second driving member 24 by the six linkage structures 26 through the six second links 263, respectively. In this way, the belt pulley can be in power connection with the second driving member 24 through the six linkage structures 26 at six positions circumferentially, respectively. Therefore, the stability of power transmission between the belt pulley and the second driving member 24 can be ensured, which can ensure that the second driving member 24 can be driven by the power source 29 to effectively rotate.

In some embodiments, second transmission holes 222 is evenly arranged at intervals in a circumferential direction of the first transmission hole 221, i.e., angles between any two adjacent second transmission holes 222 among second transmission holes 222 in the circumferential direction of the belt pulley are the same. As illustrated in FIG. 6, six second transmission holes 222 are evenly arranged at intervals in the circumferential direction of the first transmission hole 221, i.e., an angle between two adjacent second transmission holes 222 is 60°. In one embodiment, the six second transmission holes 222 are distributed in three pairs in the circumferential direction of the belt pulley, and the two second transmission holes 222 of each pair are arranged directly facing towards each other in the axial direction of the belt pulley.

Therefore, when the six linkage structures 26 are in transmission engagement with the belt pulley, a force of each of the six linkage structures 26 in the circumferential direction of the belt pulley is balanced, which can avoid too great stress at a local position or too small stress at the local position, and prevent serious abrasion caused by excessive stress at the local position from occurring. Meanwhile, after the six linkage structures 26 are distributed in the circumferential direction of the belt pulley, the two linkage structures 26 of each pair of linkage structures 26 are arranged directly facing towards each other in the radial direction of the belt pulley. In this way, stresses at two side regions of the belt pulley are also balanced radially. In this way, it is possible to ensure that the belt pulley has balanced stress radially and circumferentially. In one embodiment, it is advantageous to improve transmission stability between the belt pulley and the linkage structures 26.

Third transmission holes 245 is evenly arranged at intervals in a circumferential direction of the avoidance hole 244, i.e., angles between any two adjacent third transmission holes 245 among third transmission holes 245 in the circumferential direction of the second driving member 24 are the same. As illustrated in FIG. 6, six third transmission holes 245 are evenly arranged at intervals in the circumferential direction of the avoidance hole 244, i.e., an angle between two adjacent third transmission holes 245 is 60°. In one embodiment, the six third transmission holes 245 are distributed in three pairs in the circumferential direction of the second driving member 24, and the two third transmission holes 245 of each pair are arranged directly facing towards each other in the radial direction of the second driving member 24.

Therefore, when the six linkage structures 26 are in transmission engagement with the second driving member 24, stresses of the six linkage structures 26 in the circumferential direction of the second driving member 24 are balanced, which can avoid too large stress and too small stress at the local position, and prevents serious abrasion caused by excessive stress at the local position from occurring. Meanwhile, after the six linkage structures 26 are distributed in the circumferential direction of the second driving member 24, the two linkage structures 26 of each pair of linkage structures 26 are arranged directly facing towards each other in the radial direction of the second driving member 24, allowing the stresses at two side regions in the radial direction of the second driving member 24 are balanced. In this way, it is possible to ensure that the second driving member 24 has balanced stress radially and circumferentially. In one embodiment, it is advantageous to improve the transmission stability between the second driving member 24 and the linkage structures 26.

In this way, by arranging the six linkage structures 26 between the second driving member 24 and the belt pulley at a special position, stable transmission between the second driving member 24 and the belt pulley can be ensured. In one embodiment, excessive abrasion at the local position and transmission deformation are not prone to occur, which improves safety and reliability of structural design.

In some embodiments, the transmission component 21 further includes a bearing support block 27 rotatably supported at the second driving member 24. As illustrated in FIG. 3, the second driving member 24 includes a transmission portion 241 and a support connection portion 242. The transmission shaft 25 penetrates the support connection portion 242 and the transmission portion 241 sequentially. The third transmission hole 245 is formed at the support connection portion 242 and is open towards a side facing away from the transmission portion 241 to be connected and engaged with the second link 263.

Here, the transmission portion 241 has a radial dimension greater than a radial dimension of the support connection portion 242. A middle part of the transmission portion 241 is open towards the roller brush body 11 to form a middle mounting space. The avoidance hole 244 is formed at the support connection portion 242 and penetrates the transmission portion 241 to the middle mounting space of the transmission portion 241. A radial dimension of the middle mounting space is greater than a radial dimension of the avoidance hole 244. As illustrated in FIG. 3, the bearing 4 is mounted in the middle mounting space, and the bearing support block 27 is rotatably supported in the middle mounting space through the bearing 4, enabling the bearing support block 27 to be rotatable in the second driving member 24.

The bearing support block 27 has an eccentric hole 271. An axis of the eccentric hole 271 is offset from the axis of the avoidance hole 244. The transmission shaft 25 is rotatably supported at the eccentric hole 271. As illustrated in FIG. 6, the bearing support block 27 is a circular block, and the eccentric hole 271 is arranged at a lower part of the bearing support block 27, i.e., the axis of the eccentric hole 271 is lower than an axis of the bearing support block 27. Therefore, the transmission shaft 25 may be rotatably supported at a lower part of the bearing support block 27 through the bearing 4.

It should be noted that the bearing support block 27 is mounted at a lower part in the second driving member 24, and is simultaneously rotatably engaged with the second driving member 24 and the transmission shaft 25 through the bearing 4. In this way, during actual operation, the second driving member 24 may be driven by the belt pulley through the linkage structure 26 to rotate relative to the bearing support block 27, to drive the sleeve 12 to rotate. Meanwhile, the first driving member 23 may be driven by the belt pulley through the transmission shaft 25 to rotate relative to the bearing support block 27, to drive the roller brush body 11 to rotate. Therefore, the eccentric rotation of the roller brush body 11 relative to the sleeve 12 can be achieved.

In the present disclosure, through the design of the bearing support block 27, the first driving member 23 and the second driving member 24 may be reasonably and eccentrically mounted. Meanwhile, reasonably eccentrical rotation of the first driving member 23 and the second driving member 24 may be realized through an engagement between the linkage structure 26 and the transmission shaft 25. In this way, the roller brush body 11 and the sleeve 12 can be easily rotated and driven by the same belt pulley in two different paths, respectively. Therefore, during the operation of the floor brush assembly 100, the bristles 112 can be effectively extended from and retracted into the sleeve 12, which realizes the cleaning of the ground and removal of the elongated objects on the bristles 112. In one embodiment, reasonability of the structural design and the practicability of the floor brush assembly 100 can be improved.

In some embodiments, the floor brush assembly further includes a motor support 281 and a driving side end cover 282. The motor support 281 is connected to the power source 29, and the driving side end cover 282 is removably mounted at the motor support 281. As illustrated in FIG. 6, three connection posts are provided on each of an outer peripheral wall of the motor support 281 and an outer peripheral wall of the driving side end cover 282. Each of the three connection posts has a connection hole passing through the connection post in an axial direction of the transmission shaft 25. Thus, three bolts may be provided for passing through the connection holes of the connection posts in a circumferential direction of the motor support 281, to realize connection and fixation between the motor support 281 and the driving side end cover 282. In addition, the motor support 281 and the driving side end cover 282 can be flexibly disassembled and assembled. Therefore, the structure is simple, and disassembly and assembly are convenient, which facilitates subsequent disassembly and replacement of internal components.

As illustrated in FIG. 4, the motor support 281 is mounted to and engaged with the driving side end cover 282 to form a driving casing 28 of the transmission component 21. The motor support 281 is fixedly connected to a housing of the drive motor, allowing the transmission component 21 and the power source 29 to be formed into an integrated structure through the connection. The motor support 281 is connected to a driving side to define a mounting space. The belt pulley and the linkage structure 26 are mounted in the mounting space, allowing the motor support 281 and the driving side end cover 282 to protect engagement structures among the belt pulley, the linkage structure 26, and other components. As illustrated in FIG. 6, the motor support 281 has a guide cavity open towards the driving wheel 291 of the drive motor. In one embodiment, the belt 3 has an end sleeved over the belt pulley, and another end extending to the driving wheel 291 through the guide cavity to be sleeved over the driving wheel 291. In this way, the belt 3 can provide transmission between the belt pulley and the driving wheel 291.

Here, an end of the transmission shaft 25 away from the roller brush body 11 is rotatably supported at the driving side end cover 282, and the second driving member 24 is rotatably supported at the motor support 281. As illustrated in FIG. 3, a right end of the transmission shaft 25 is rotatably supported on the driving side end cover 282 through the bearing 4, enabling the transmission shaft 25 to rotate relative to the motor support 281 and the driving side end cover 282. A mounting through hole is formed at a side wall of the motor support 281, and the second driving member 24 is rotatably supported on the side wall of the motor support 281 through the bearing 4. As illustrated in FIG. 6, the bearing 4 is sleeved over the support connection portion 242 of the second driving member 24. That is, an inner ring of the bearing 4 is fixedly connected to an outer peripheral wall of the support connection portion 242, and an outer peripheral wall of the bearing 4 is fixedly supported at an inner peripheral wall of a mounting through hole.

Therefore, mounting of an internal structure the transmission component 21 can be achieved. In one embodiment, the structure is simple, and the mounting is convenient. As illustrated in FIG. 6, outer protruding teeth are provided at an outer peripheral wall of the belt pulley, and inner protruding teeth are provided at an inner peripheral wall of the belt 3, allowing the inner protruding teeth to be in meshing transmission with the outer protruding teeth. Therefore, it is beneficial to increase an engagement between the belt 3 and the belt pulley. In one embodiment, it is possible to prevent the belt pulley to slip relative to the belt 3 during transmission, and transmission reliability of the belt 3 can be improved.

Figure 5:
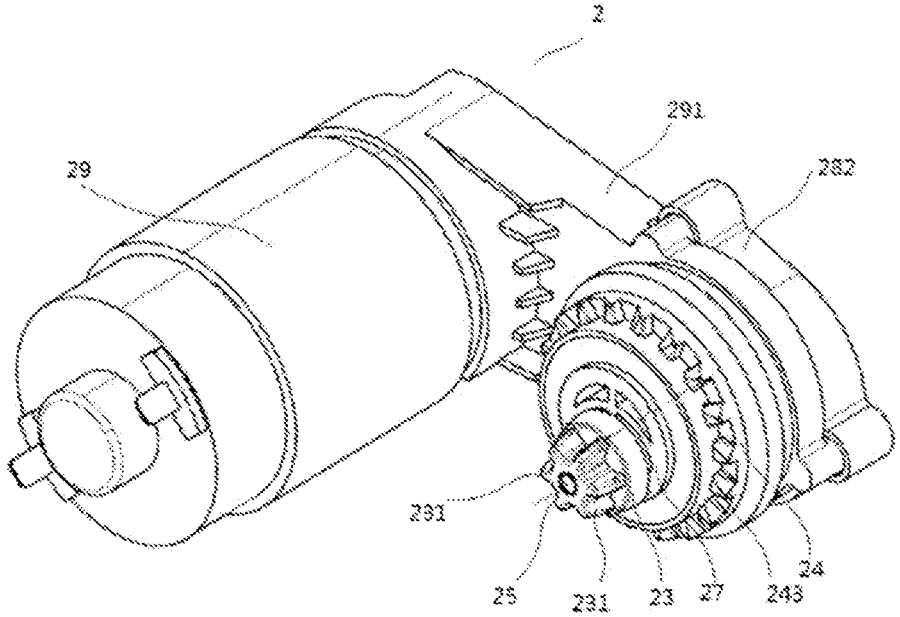
FIG. 5 is a schematic structural view of a driving mechanism of a floor brush assembly according to an embodiment of the present disclosure.

In some embodiments, the first driving member 23 is provided with first driving teeth 231 at a side of the first driving member 23 facing towards the roller brush body 11, and the roller brush body 11 is provided with first driven teeth 111 at a side of the roller brush body 11 facing towards the first driving member 23. The first driving teeth 231 are engaged with the first driven teeth 111. As illustrated in FIG. 5 and FIG. 6, the first driving teeth 231 are formed at an outer peripheral wall of the first driving member 23, and radially protrude outwards from the outer peripheral wall of the first driving member 23. Further, the first driving teeth 231 extend to a side surface of the first driving member 23 facing towards the roller brush body 11. In one embodiment, as illustrated in FIG. 7, the first driven teeth 111 are formed at an inner peripheral wall of the right end of the roller brush body 11, and radially protrude inwards from an inner peripheral wall of the roller brush body 11. Further, the first driven teeth 111 extend to a side surface of the roller brush body 11 facing towards the first driving member 23. In this way, the first driven teeth 111 and the first driving teeth 231 may be engaged with each other axially in an inserting manner. Further, the first driven teeth 111 and the first driving teeth 231 are limited relative to each other and engaged with each other circumferentially, enabling the first driving member 23 to drive the first driven teeth 111 and the roller brush body 11 to rotate through the first driving teeth 231.

The second driving member 24 is provided with second driving teeth 243 at a side of the second driving member 24 facing towards the sleeve 12, and the sleeve 12 is provided with second driven teeth 121 at a side of the sleeve 12 facing towards the second driving member 24. The second driving teeth 243 are engaged with the second driven teeth 121. As illustrated in FIG. 5 and FIG. 6, the second driving teeth 243 are formed at an outer peripheral wall of the second driving member 24 and radially protrude outwards from the outer peripheral wall of the second driving member 24. Further, the second driving teeth 243 extend to a side surface of the second driving member 24 facing towards the sleeve 12. As illustrated in FIG. 7, the second driven teeth 121 are formed at an inner peripheral wall of the right end of the sleeve 12, and radially protrude inwards from an inner peripheral wall of the sleeve 12. Further, the second driven teeth 121 extend to a side surface of the sleeve 12 facing towards the second driving member 24. In this way, the second driven teeth 121 and the second driving teeth 243 may be engaged with each other axially in an inserting manner. Further, the second driven teeth 121 and the second driving teeth 243 are limited relative to each other and engaged with each other circumferentially, allowing the second driving member 24 to drive the second driven teeth 121 and the sleeve 12 to rotate through the second driving teeth 243.

Therefore, the first driving member 23 is in meshing transmission with the roller brush body 11 through teeth structures, and the second driving member 24 is in meshing transmission with the sleeve 12 through teeth structures, which enables the power source 29 to well drive the roller brush body 11 and the sleeve 12 to rotate through the transmission component 21, achieving a cleaning effect on the ground.

According to embodiments of the present disclosure, a vacuum cleaner 1000 is also provided.

In the vacuum cleaner 1000 according to an embodiment of the present disclosure, the floor brush assembly 100 for the vacuum cleaner according to any one of the above embodiments is provided, and the first driving member 23 and the second driving member 24 are eccentrically arranged to allow the bristles 112 to be selectively extended out of or retracted into the sleeve 12, which can solve a problem in which the roller brush body 11 becomes tangled with elongated objects such as hair and threads. In addition, the belt pulley and the two driving members are in transmission cooperation with each other in the form of the transmission shaft 25 and the linkage structure 26, which is beneficial to lowering requirements for the assembly precision, to improve mounting efficiency and reducing component wear during transmission. In one embodiment, unrotation due to jerking of the belt can be avoided. Therefore, it is possible to avoid misalignment between the roller brush 11 and the sleeve 12, to improve overall performance of the floor brush assembly 100.

In the description of the present disclosure, it is to be understood that, terms such as "central", "longitudinal", "transverse", "length", "width", "thickness", "upper", "lower", "front", "rear", "back", "left", "right", "vertical", "horizontal", "top", "bottom", "inner", "outer", "clockwise", "counterclockwise", "axial", "radial", and "circumferential", should be constructed to refer to the orientation or position as described or as shown in the drawings, and is only for the convenience of describing the present disclosure and simplifying the description, rather than indicating or implying that the pointed device or element must have a specific orientation, or be constructed and operated in a specific orientation, and therefore cannot be understood as a limitation of the present disclosure.

In the description of the present disclosure, "the first feature" and "the second feature" may include at least one of the features.

In the description of the present disclosure, "plurality" means at least two.

In the description of the present disclosure, the first feature being "on" or "under" the second feature may include the scenarios that the first feature is in direct contact with the second feature, or the first and second features, instead of being in direct contact with each other, are in contact with each other through another feature therebetween.

In the description of the present disclosure, the first feature being "above" the second feature may indicate that the first feature is directly above or obliquely above the second feature, or simply indicate that the level of the first feature is higher than that of the second feature.

In the description of this specification, descriptions with reference to the terms "an embodiment", "some embodiments", "schematic embodiments", "examples", "specific examples", or "some examples" etc., mean that specific features, structure, materials or characteristics described in conjunction with the embodiment or example are included in at least one embodiment or example of the present disclosure. In this specification, the schematic representations of the above terms do not necessarily refer to the same embodiment or example. In one embodiment, the described specific features, structures, materials or characteristics may be combined in any one or more embodiments or examples in a suitable manner.

Although embodiments of the present disclosure have been illustrated and described, it is conceivable for various changes, modifications, replacements, and variations can be made to these embodiments. The scope of the present disclosure shall be defined by the claims as appended and their equivalents.

What is claimed is:

1. A floor brush assembly for a vacuum cleaner, the floor brush assembly comprising:

a roller brush component, the roller brush component comprising a sleeve and a roller brush body rotatably mounted in the sleeve, the roller brush body being provided with bristles; and a driving mechanism, the driving mechanism comprising a power source and a transmission component, the transmission component comprising a first driving member, a second driving member, and a driving wheel connected to the power source, wherein:

the driving wheel is connected to the first driving member through a transmission shaft to drive the roller brush body to rotate;

the driving wheel is connected to the second driving member through a linkage structure to drive the sleeve to rotate; and the first driving member and the second driving member are eccentrically arranged to allow the bristles to be selectively extended out of or retracted into the sleeve.

2. The floor brush assembly according to claim 1, wherein the driving wheel has a first transmission hole and a second transmission hole located at a radial outer side of the first transmission hole, and wherein the second driving member has an avoidance hole and a third transmission hole located at a radial outer side of the avoidance hole, wherein:

the transmission shaft passes through the first transmission hole and is relatively fixed to the driving wheel circumferentially;

the transmission shaft passes through the avoidance hole to be connected to the first driving member; and the linkage structure has an end extending into the second transmission hole to be rotatably engaged with the driving wheel and another end extending into the third transmission hole to be rotatably engaged with the second driving member.

3. The floor brush assembly according to claim 2, wherein:

an axis of the first transmission hole is coincident with a rotation axis of the driving wheel;

an axis of the avoidance hole is coincident with a rotation axis of the second driving member; and an axis of the transmission shaft is offset from the axis of the avoidance hole.

4. The floor brush assembly according to claim 3, wherein the linkage structure comprises a first link, a connection block, and a second link, wherein:

the first link and the second link are respectively connected to two ends of the connection block and extend away from each other from two sides of the connection block;

the first link extends into the second transmission hole; and the second link extends into the third transmission hole.

5. The floor brush assembly according to claim 3, wherein:

a plurality of second transmission holes is provided and arranged at intervals around the first transmission hole;

a plurality of third transmission holes is provided and arranged at intervals around the avoidance hole; and a plurality of linkage structures is provided, the plurality of linkage structures, the plurality of second transmission holes, and the plurality of third transmission holes being arranged in one-to-one correspondence.

6. The floor brush assembly according to claim 5, wherein:

the plurality of second transmission holes is evenly arranged at intervals in a circumferential direction of the first transmission hole; and the plurality of third transmission holes is evenly arranged at intervals in a circumferential direction of the avoidance hole.

7. The floor brush assembly according to claim 3, wherein the transmission component further comprises a bearing support block rotatably supported at the second driving member, the bearing support block having an eccentric hole, an axis of the eccentric hole being offset from the axis of the avoidance hole, and the transmission shaft being rotatably supported at the eccentric hole.

8. The floor brush assembly according to claim 1, further comprising:

a motor support connected to the power source; and a driving side end cover detachably mounted at the motor support, wherein an end of the transmission shaft away from the roller brush body is rotatably supported at the driving side end cover, and the second driving member is rotatably supported at the motor support.

9. The floor brush assembly according to claim 1, wherein:

the first driving member is provided with first driving teeth at a side of the first driving member facing towards the roller brush body;

the roller brush body is provided with first driven teeth at a side of the roller brush body facing towards the first driving member, the first driving teeth being engaged with the first driven teeth;

the second driving member is provided with second driving teeth at a side of the second driving member facing towards the sleeve; and the sleeve is provided with second driven teeth at a side of the sleeve facing towards the second driving member, the second driving teeth being engaged with the second driven teeth.

10. A vacuum cleaner, comprising:

a floor brush assembly, comprising:

a roller brush component, the roller brush component comprising a sleeve and a roller brush body rotatably mounted in the sleeve, the roller brush body being provided with bristles; and a driving mechanism, the driving mechanism comprising a power source and a transmission component, the transmission component comprising a first driving member, a second driving member, and a driving wheel connected to the power source, wherein:

the driving wheel is connected to the first driving member through a transmission shaft to drive the roller brush body to rotate;

the driving wheel is connected to the second driving member through a linkage structure to drive the sleeve to rotate; and the first driving member and the second driving member are eccentrically arranged to allow the bristles to be selectively extended out of or retracted into the sleeve.

11. The vacuum cleaner according to claim 10, wherein the driving wheel has a first transmission hole and a second transmission hole located at a radial outer side of the first transmission hole, and wherein the second driving member has an avoidance hole and a third transmission hole located at a radial outer side of the avoidance hole, wherein:

the transmission shaft passes through the first transmission hole and is relatively fixed to the driving wheel circumferentially;

the transmission shaft passes through the avoidance hole to be connected to the first driving member; and the linkage structure has an end extending into the second transmission hole to be rotatably engaged with the driving wheel and another end extending into the third transmission hole to be rotatably engaged with the second driving member.

12. The vacuum cleaner according to claim 11, wherein:

an axis of the first transmission hole is coincident with a rotation axis of the driving wheel;

an axis of the avoidance hole is coincident with a rotation axis of the second driving member; and an axis of the transmission shaft is offset from the axis of the avoidance hole.

13. The vacuum cleaner according to claim 12, wherein the linkage structure comprises a first link, a connection block, and a second link, wherein:

the first link and the second link are respectively connected to two ends of the connection block and extend away from each other from two sides of the connection block;

the first link extends into the second transmission hole; and the second link extends into the third transmission hole.

14. The vacuum cleaner according to claim 12, wherein:

a plurality of second transmission holes is provided and arranged at intervals around the first transmission hole;

a plurality of third transmission holes is provided and arranged at intervals around the avoidance hole; and a plurality of linkage structures is provided, the plurality of linkage structures, the plurality of second transmission holes, and the plurality of third transmission holes being arranged in one-to-one correspondence.

15. The vacuum cleaner according to claim 14, wherein:

the plurality of second transmission holes is evenly arranged at intervals in a circumferential direction of the first transmission hole; and the plurality of third transmission holes is evenly arranged at intervals in a circumferential direction of the avoidance hole.

16. The vacuum cleaner according to claim 12, wherein the transmission component further comprises a bearing support block rotatably supported at the second driving member, the bearing support block having an eccentric hole, an axis of the eccentric hole being offset from the axis of the avoidance hole, and the transmission shaft being rotatably supported at the eccentric hole.

17. The vacuum cleaner according to claim 10, further comprising:

a motor support connected to the power source; and a driving side end cover detachably mounted at the motor support, wherein an end of the transmission shaft away from the roller brush body is rotatably supported at the driving side end cover, and the second driving member is rotatably supported at the motor support.

18. The vacuum cleaner according to claim 10, wherein:

the first driving member is provided with first driving teeth at a side of the first driving member facing towards the roller brush body;

the roller brush body is provided with first driven teeth at a side of the roller brush body facing towards the first driving member, the first driving teeth being engaged with the first driven teeth;

the second driving member is provided with second driving teeth at a side of the second driving member facing towards the sleeve; and the sleeve is provided with second driven teeth at a side of the sleeve facing towards the second driving member, the second driving teeth being engaged with the second driven teeth.

* * * * *